US005918579A

United States Patent [19]

Kettenacker et al.

[11] Patent Number: 5,918,579

[45] **Date of Patent: *Jul. 6, 1999**

[54] PROCESS AND DEVICE FOR CONTROLLING AN INTERNAL COMBUSTION ENGINE

[75] Inventors: Guenter Kettenacker, Steinheim; Ulrich Gerstung, Vaihingen; Michael Schueller, Friolzheim, all of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/724,465

[22] Filed: Oct. 1, 1996

[30] Foreign Application Priority Data

Oct. 11, 1995 [DE] Germany ..... 195 37 786

[51] Int. Cl.[6] ..... F02D 41/04

[52] U.S. Cl. ..... 123/491; 123/326; 123/436; 701/102; 701/110; 701/103

[58] Field of Search ..... 123/491, 494, 123/436, 492, 339.1, 326; 364/431.05; 701/102, 103, 105, 110, 113

[56] References Cited

U.S. PATENT DOCUMENTS

| | | | |
|---|---|---|---|
| 4,100,892 | 7/1978 | Asano | 123/696 |
| 4,510,911 | 4/1985 | Otobe | 123/493 |
| 4,516,550 | 5/1985 | Buck et al. | 123/357 |
| 4,805,579 | 2/1989 | Toshimitsu et al. | 123/326 |
| 4,825,369 | 4/1989 | Oshizawa | 701/105 |
| 5,253,630 | 10/1993 | Akazaki et al. | 123/682 |
| 5,301,648 | 4/1994 | Uchinami | 123/491 |
| 5,320,079 | 6/1994 | Kuwabara | 123/491 |
| 5,322,044 | 6/1994 | Maebashi | 123/491 |
| 5,345,908 | 9/1994 | Nishimura et al. | 123/339.1 |
| 5,353,768 | 10/1994 | Messih et al. | 123/491 |
| 5,441,030 | 8/1995 | Satsukawa | 123/491 |
| 5,444,627 | 8/1995 | Sandborg et al. | 364/431.05 |
| 5,506,771 | 4/1996 | Chan et al. | 123/493 |
| 5,507,265 | 4/1996 | Ichikawa et al. | 123/491 |
| 5,529,548 | 6/1996 | Mack | 701/110 |
| 5,577,482 | 11/1996 | Nakashima | 123/491 |
| 5,595,161 | 1/1997 | Ott et al. | 123/491 |
| 5,605,138 | 2/1997 | Deichsel et al. | 123/491 |

FOREIGN PATENT DOCUMENTS

| | | | |
|---|---|---|---|
| 24 40 013 | 3/1976 | Germany | 123/491 |
| 58-041240 | 3/1983 | Japan . | |

*Primary Examiner*—Willis R. Wolfe
*Assistant Examiner*—Hieu T. Vo
*Attorney, Agent, or Firm*—Kenyon & Kenyon

[57] ABSTRACT

A process and a device for controlling an internal combustion engine, specifically an internal combustion engine with self-ignition. Depending on different operating parameters, a signal determining the output power can be defined. The signal determining the output power is increased by a predefined value when a start condition is present and when a further condition is met.

18 Claims, 2 Drawing Sheets

PROCESS AND DEVICE FOR CONTROLLING AN INTERNAL COMBUSTION ENGINE

BACKGROUND INFORMATION

German Patent Application No. 24 40 013 describes a process and devices for controlling an internal combustion engine. In the case of this process and these devices for controlling an internal combustion engine, the amount to be injected when the engine is started is increased, after a waiting period, by a temperature-dependent value, which is then continuously diminished over time.

In the case of this process and these devices for controlling an internal combustion engine, the speed of the internal combustion engine may increase very slowly or insufficiently at start. This means the dynamics of the vehicle, i.e., the acceleration characteristics of the vehicle, are very poor, which in the worst-case scenario results in stalling on a slope.

This starting problem occurs specifically when the vehicle starts with increased load, for example, when it is stopped on an upward slope, or when the fuel used is of poor quality, or other unfavorable thermal or atmospheric conditions are present.

SUMMARY OF THE INVENTION

An object of the present invention is to provide a process and a device for controlling an internal combustion engine ensuring quick engine speed increase at start under all circumstances.

With the process of the present invention, a sufficiently quick engine speed increase can be achieved even under unfavorable circumstances.

DETAILED DESCRIPTION

Figure 1:
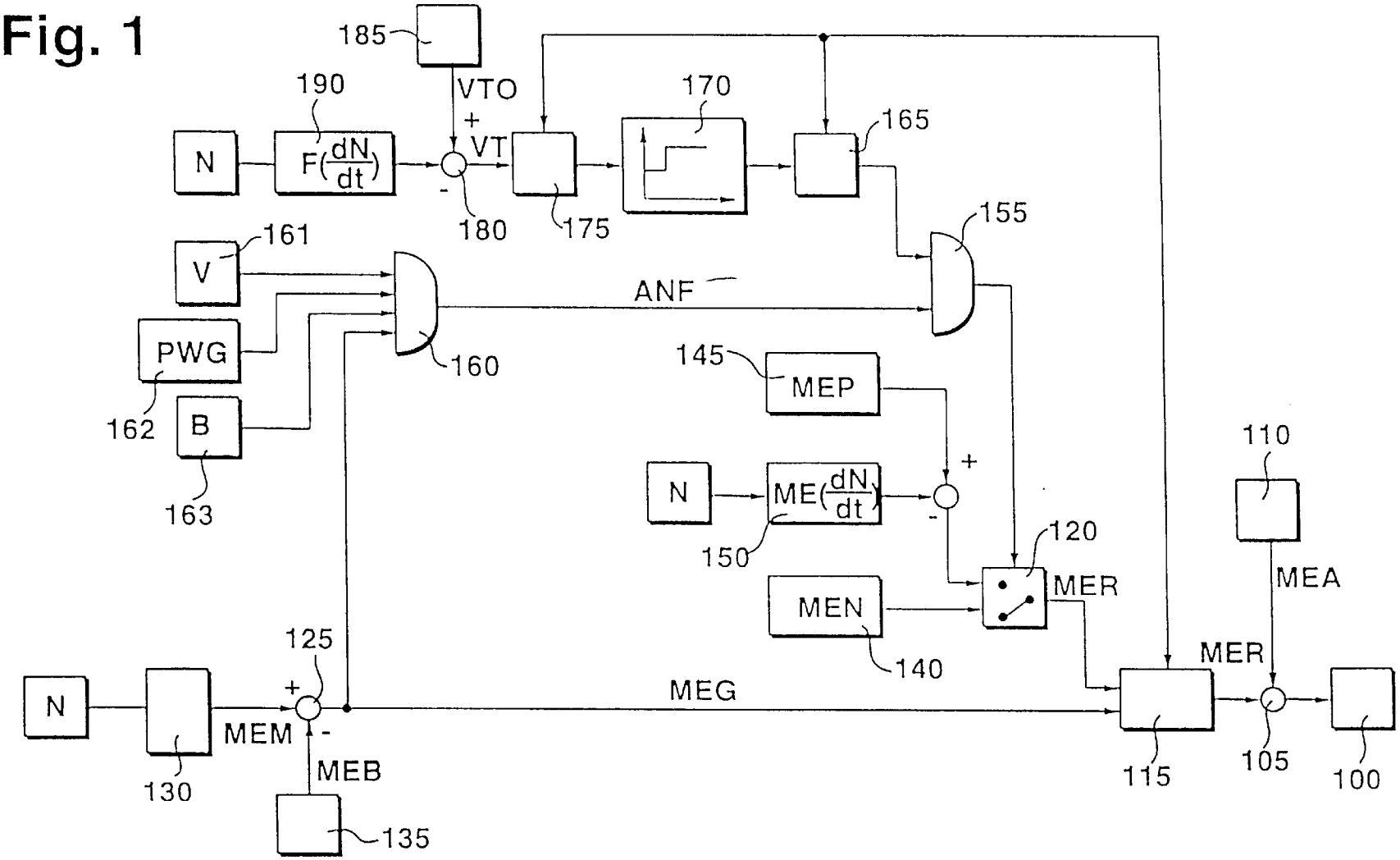
FIG. 1 shows a functional block diagram of the device according to the present invention.

In the following, the process according to the present invention is explained using the example of a diesel internal combustion engine.

The number 100 denotes the actuator that determines the power output. In the case of a diesel internal combustion engine, this is the adjusting rod of a pump connected in series or the adjustment rod of a distributor pump. In the case of solenoid valve-controlled systems, this is a solenoid valve that determines the fuel dosage. In the case of externally ignited internal combustion engines, actuator 100 is an actuating device for changing the throttle valve position.

The output signal of a connecting node 105 is supplied to this actuator 100 as the signal determining the power output. The connecting node 105 processes the output signal MEA of a starting amount lookup table block 110, as well as the output signal MER of an extra amount ramp block 115.

A processor 400 performs the functions contained in the blocks of FIG. 1, as described below.

The output signal of a switching block 120 and the output signal of a connecting node 125 are supplied to extra amount ramp block 115.

Connecting node 125 forms the difference of output signal value MEM of a lookup table (or map) block 130, where the maximum allowable starting amount is stored, and signal value MEB of a limiting map block 135, to provide a limiting value MEG. Lookup table block 130 receives an engine speed signal N, among others.

In the rest position, switching block 120 provides fuel amount reduction setpoint block 140 to extra amount ramp block 115. When switching block 120 is activated, it connects extra amount setpoint block 145 to extra amount ramp block 115. Extra amount setpoint block 145 provides output signal MEP with a plus sign to the minus sign of output signal ME (dN/dt) provided by negative feedback block 150. Negative feedback block 150 receives engine speed signal N, among others.

Switching block 120 is activated by the output of an AND gate 155. The AND gate 155 connects the output signal ANF of a second AND gate 160 and the output signal of a holding block 165. The output signals of connecting node 125, of a speed condition sensor 161, of pedal condition sensor 162, as well as of a brake sensor 163, are supplied to second AND gate 160.

A signal is supplied by delay block 170 to holding block 165. The delay block 170, in turn, receives a signal from a switching block 175. The switching block 175 processes the output signal VT of a connecting node 180 to whose one input the output signal VTO of a delay time setpoint block 185 is applied with a plus sign and to whose second input the output signal F(dN/dt) of a delay correction block 190 is applied with a minus sign. Delay correction block 190 receives the engine speed signal N, among others.

Extra amount ramp block 115 supplies activating signals to holding block 165 and connecting node 125. Similarly, second AND gate 160 supplies an activating signal to switching block 175.

Figure 2A:
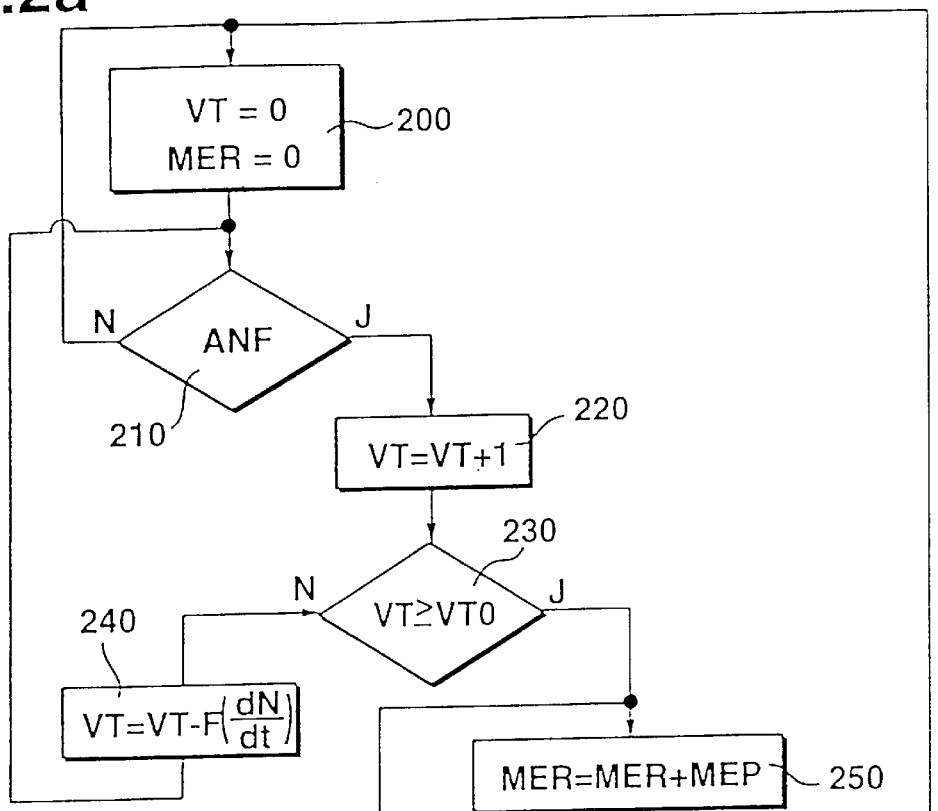
FIG. 2*a* shows a flow diagram of the process according to the present invention.

The operation of this device is explained below using the flow charts of FIGS. 2*a* and 2*b*. In a first step 200, the system is initialized. The extra amount MER of extra amount ramp block 115 and delay VT are set to 0. An end value VTO for the delay is provided by delay time setpoint block 185. Subsequently, query 210 checks whether a start (drive-off) condition ANF is present. If this is not the case, step 200 is repeated. If this is the case, delay VT is increased by a fixed value in step 220.

Query 230 checks whether the value of delay VT is less than or equal to an end value VTO. If this is not the case, the delay is reduced by a correction value F in step 240. This correction value F(dN/dt) depends on the change in the engine speed, specifically on the increase in the engine speed. The correction value is provided by delay correction block 190. If the engine speed increases, delay VT is reduced. This means that a positive value is subtracted. Subsequently the delay corrected by delay correction block 190 is present at the output of connecting node 180. If query 230 determines that the delay is greater than or equal to the end value VTO, this means that the delay VT has elapsed and one time condition has been met, so step 250 follows. This means that the output signal of delay block 170 goes high, and is held high by holding block 165 until extra amount ramp block 115 issues a suitable reset signal.

In step 250 the value of extra amount MER is increased by a small positive value MEP, provided by extra amount setpoint block 145. Subsequently, in step 260, extra amount MER is diminished by a correction ME(dN/dt) dependent on the change in the engine speed, specifically on the increase in the engine speed, which correction is provided by negative feedback block 150.

The extra amount MER is increased only when delay VT has elapsed and start condition ANF is present. In this case, AND gate 155 activates switching block 120, and the output signal of extra amount setpoint block 145 is sent to extra amount ramp block 115.

In extra amount ramp block 115, the extra amount MER is limited to limiting value MEG, which is the limit value for the extra amount. This means that step 260 is followed by query 270, which checks whether extra amount MER is greater than or equal to limit value MEG. If this is the case, the extra amount is set to limit value MEG in step 275.

Subsequently query 280 checks whether the start condition ANF is still present. If this is the case, step 250 is repeated. If the start condition is not present, i.e., signal ANF is no longer present, then switching block 120 is set to its rest position. This means that in step 285 extra amount MER is reduced by the value MEN of fuel amount reduction setpoint block 140. Subsequently query 290 checks whether extra amount MER is less than or equal to zero. If this is not the case, query 280 is repeated. If this is the case, step 200 follows. This means that as soon as the extra amount MER becomes less than or equal to zero, the delay is reset to its initial value and holding block 165 is reset to zero.

If query 280 determines that the start condition ANF is present, the extra amount MER is further increased until the limit value MEG is reached. If query 280 determines that the start condition is no longer present, the amount is reduced by the amount MEN. As soon as the start condition ANF is present again, the amount is increased again by the value MEP.

According to the present invention, if the start condition is present, the extra amount (MER) increases over time until the limit value MEG is reached. When the start condition ANF is no longer present, the extra amount decreases over time until the amount reaches the original value it had prior to the increase.

Figure 2B:
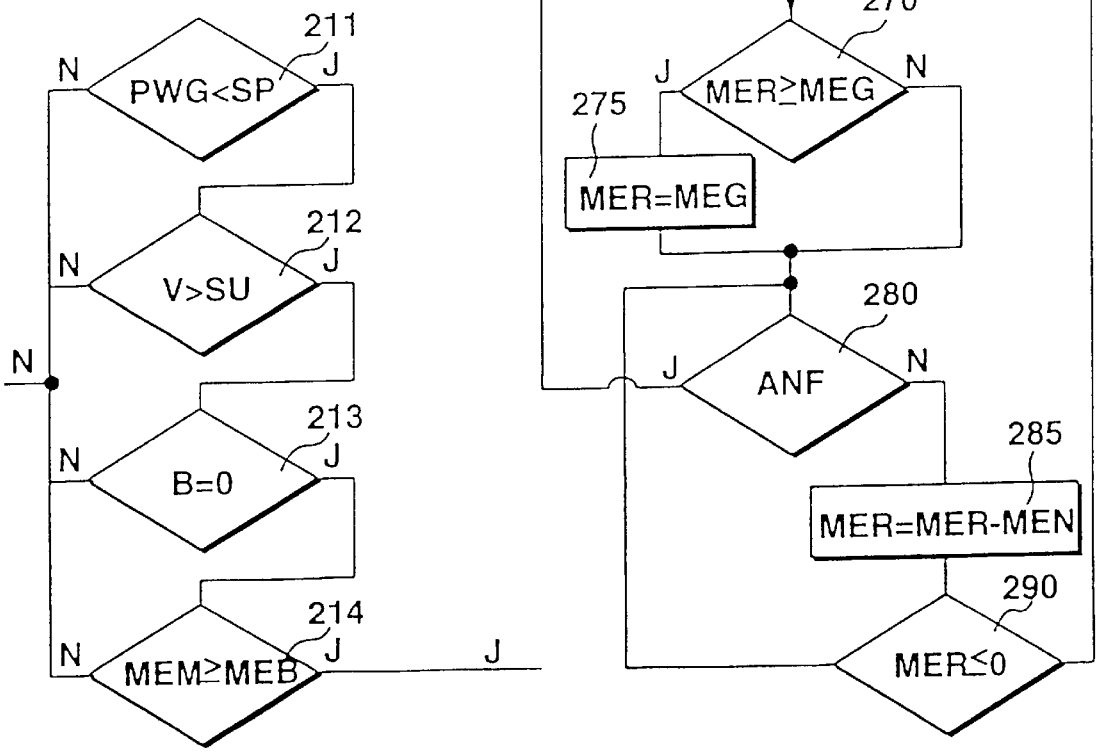
FIG. 2*b* shows a flow diagram detailing a portion of FIG. 2*a*.

Query 210 and query 280 check whether the start condition ANF is present; these procedures are illustrated in detail in FIG. 2*b*. This query corresponds to second AND gate 160.

A first query 211 checks if an accelerator pedal position signal PWG is greater than a threshold value SP. If this is not the case, it is determined that the start condition ANF is not present. This condition checks whether the accelerator pedal is actuated.

If this is the case, query 212 checks whether a travel speed signal V is greater than a threshold value SV. If the travel speed signal V is greater than the threshold value, it is concluded that the start condition ANF is not present.

If the travel speed V is greater than the threshold value SV, query 213 checks whether the brake B of the vehicle has not been actuated. If the brake B has been actuated, it is concluded that the start condition ANF is not present. For this purpose, the position of a brake light switch is analyzed, for example.

If the brake B has not been actuated, query 214 follows, which checks whether the output signal MEM of lookup table block 130 is greater than the output signal MED of limiting map block 135. If this is not the case, it is concluded that the start condition ANF is present.

The conclusion that the start condition ANF is present is drawn only if the accelerator pedal position value PWG is greater than a threshold value SP, the speed is less than a threshold value SV, the output signal value MEB of limiting map block 135 is less than the maximum possible starting amount MEM, and the brake B has not been actuated. Conditions may be added or removed in individual embodiments of the present invention. After a desired start has been recognized and after a delay VT, the starting amount is gradually increased.

In order to be able to apply delay VT in a short time without having it elapse too rapidly in the case of a normal start, this delay is dynamically extended as a function of the engine speed increase. A delay VTO is defined for this purpose, which is then reduced by a value dependent on the increase in engine speed. Delay VT is reduced by a small amount in absolute value in the case of a large increase in engine speed, while it is reduced by a large amount in absolute value in the case of a small increase. This means that the delay is very long for a rapid increase in engine speed and very short for a slow increase.

If the start condition ANF is not present, i.e., one of the conditions is no longer being met during the delay VT, the delay is immediately reset to its initial value.

If the delay has elapsed and the start condition ANF continues to exist, the extra amount MER is increased by a predefined value. Extra amount MER is limited to a value MEG corresponding to the difference between the maximum allowable extra amount and the output signal MEB of limiting map block 135.

If the start condition ANF is not present during the increase ramp, the amount ramp is reduced by negative slope MEN. When the presence of the start condition ANF is recognized again, the amount ramp is immediately increased by positive slope MEP. If the extra amount reaches zero again, the delay is reset. The amount does not continue to increase until the delay has elapsed.

An engine speed increase negative feedback block 150 is provided so that the increase in the amount of fuel that is necessary for the increase in the engine speed does not always increase to the maximum allowable value. The instantaneous amount ramp value is reduced, according to the current engine speed increase, by a correction value ME, dependent on the increase in engine speed.

What is claimed is:

1. A device for controlling an internal combustion engine, comprising:

a processor determining when the engine is started to determine a presence of a start condition and determining when a traveling speed of a motor vehicle increases from a zero value to determine a presence of a drive-off condition, the processor providing a signal which determines an output power of the engine as a function of at least one operating parameter of the engine, wherein, when the drive-off condition is present, the processor increases the signal which determines the output power over time after a waiting time, and wherein, when the drive-off condition is no longer present, the processor decreases the signal which determines the output power over time.

2. The device according to claim 1, wherein the drive-off condition is determined as a function of a speed condition, an acceleration condition and a brake condition.

3. The device according to claim 1, wherein the waiting time is longer for a rapid increase in an engine speed than for a slow increase in the engine speed.

4. The device according to claim 1, wherein a value of the waiting period is increased by a predetermined amount when the drive-off condition is present.

5. The device according to claim 1, wherein a value of the waiting period is decreased by a correction value when the value of the waiting period is less than an end value.

6. A process for controlling an internal combustion engine, comprising the steps of:

providing a signal that determines an output power of the engine as a function of at least one operating parameter of the engine;

determining when a traveling speed of a motor vehicle increases from a zero value to determine a presence of a drive-off condition;

when the drive-off condition is present, increasing the signal determining the output power over time after the elapse of a waiting period;

when the drive-off condition is no longer present, decreasing the signal determining the output power over time; and controlling the output power of the engine as a function of the signal.

7. The process according to claim 6, wherein the engine has self-ignition.

8. The process according to claim 6, wherein the at least one operating parameter includes a plurality of different operating parameters.

9. The process according to claim 6, wherein the waiting period depends upon a variation of a speed of the engine.

10. The process according to claim 9, further comprising the step of reducing a value by which the signal determining the output power increases as a function of a signal corresponding to the engine speed variation.

11. The process according to claim 1, further comprising the step of recognizing the drive-off condition when a brake has not been actuated, when a travel speed signal and an accelerator pedal signal assume preselected values.

12. The process according to claim 6, wherein the signal determining the output power corresponds to an amount of fuel to be injected into the engine.

13. The process according to claim 6, further comprising the step of limiting a value by which the signal determining the output power increases by a limit value.

14. The process according to claim 6, wherein the signal determining the output power is decreased until it reaches a value present prior to the increase.

15. The process according to claim 1, wherein the drive-off condition is determined as a function of a speed condition, an acceleration condition and a brake condition.

16. The process according to claim 1, wherein the waiting period is longer for a rapid increase in an engine speed than for a slow increase in the engine speed.

17. The process according to claim 1, further comprising the step of increasing a value of the waiting period by a predetermined amount when the drive-off condition is present.

18. The process according to claim 1, further comprising the step of decreasing a value of the waiting period by a correction value when the value of the waiting period is less than an end value.

* * * * *